US005548912A

United States Patent [19]

Liu

[11] Patent Number: 5,548,912

[45] Date of Patent: Aug. 27, 1996

[54] WATER FILLED CRYSTAL BALL STRUCTURE WITH DRIVEN STEEL BALLS

[76] Inventor: Jian Ho Liu, No. 3, Alley 202, Kao Fen Road, Hsin-Chu City, Taiwan

[21] Appl. No.: 235,540

[22] Filed: Apr. 29, 1994

[51] Int. Cl.[6] ..... G09F 19/00

[52] U.S. Cl. ..... 40/430; 40/410; 40/432; 476/36

[58] Field of Search ..... 40/415, 429, 430, 40/431, 456, 473; 476/36; 74/502.3; 446/171, 135; 472/446

[56] References Cited

U.S. PATENT DOCUMENTS 952,242 3/1910 Foams ..... 472/29

2,157,889 5/1939 Decker ..... 446/446

5,078,386 1/1992 Hou et al. ..... 472/34 X

*Primary Examiner*—Kenneth J. Dorner

*Assistant Examiner*—Cassandra Davis

*Attorney, Agent, or Firm*—Larson and Taylor

[57] ABSTRACT

This construction is one type of water filled crystal ball with driven steel balls. The main parts include, a water filled crystal ball and fixed base. On the top periphery of this round fixed base is placed a continuous track. This track is filled with steel balls. On the bottom face of the above mentioned fixed base is a rotatable flexible base which is driven by a music box spindle located in the fixed flexible base. The rotation of this base, causes the rotation and thus movement of the above mentioned steel balls which circulate within the track. Decorative objects then move within the space above the fixed base.

25 Claims, 6 Drawing Sheets

WATER FILLED CRYSTAL BALL STRUCTURE WITH DRIVEN STEEL BALLS

FIELD OF THE INVENTION

The present invention relates to crystal ball structures having movable decorative objects therein.

BACKGROUND OF THE INVENTION

This is a description of a product consisting of a water filled crystal ball structure with driven steel balls. The main components of this structure include a fixed base within a water fixed a continuous track. Within this track is installed steel balls. At the same time, installed below the above mentioned fixed base is a music box cylinder which drives a rotating flexible base. From the rotation of this flexible base and through a belt and force of friction, the steel balls in the above mentioned track are caused to role in a circulating pattern. This results in the motion above the fixed base of different decorative objects.

In other common water filled crystal balls with decorative objects, especially those which are designed to have scenes of motion, the motion may be derived from a source installed in the base, such as a motor or music box cylinder. This causes the decorative objects within the water filled crystal ball to take on different types of motion. The types of motion of decorative objects within the above mentioned water filled crystal balls has been confined to vertical and horizontal motions and up and down motions. Examples are given by U.S. Pat. Nos. 5,070,633 and 5,134,795. The types of motion in these structures are confined to paths of regular geometries. Because of this, it has been impossible to produce satisfactory ranges of motion with irregular paths such as the path of a carnival roller coaster.

SUMMARY OF THE INVENTION

The present invention is directed to a product comprising a water filled crystal ball structure with driven balls that could be made of steel. The main components of a particular embodiment of this structure include a fixed base within the water. The fixed base includes a continuous track and within this track is installed steel balls. Installed below the fixed base is a music box cylinder which drives a rotating flexible base. From the rotation of this flexible base and through a belt and force of friction, the steel balls in the track are caused to roll in a circulating pattern established by the continuous track. This results in motion above the fixed base of different decorative objects connected to the steel balls.

Precipitating from this, this are the plans for the construction of a water filled crystal ball with driven steel balls. The main concept here is that from the rotational motion of a flexible base beneath the periphery of a fixed base, is derived the driving motion for steel balls which roll in a fixed circulating track. This allows decorative objects which are attached to extension rods to move around the top of the fixed base. Because of this, the track in the fixed base can take on any kind of irregular shape. The above mentioned decorative Objects may move in an irregular shape such as a carnival roller coaster path.

DETAILED DESCRIPTION OF THE PREFERRED EMBODIMENTS OF THE INVENTION

As for the detailed description of this product and expected functionality, please refer to the following figures and attached descriptive documents.

Figure 1:
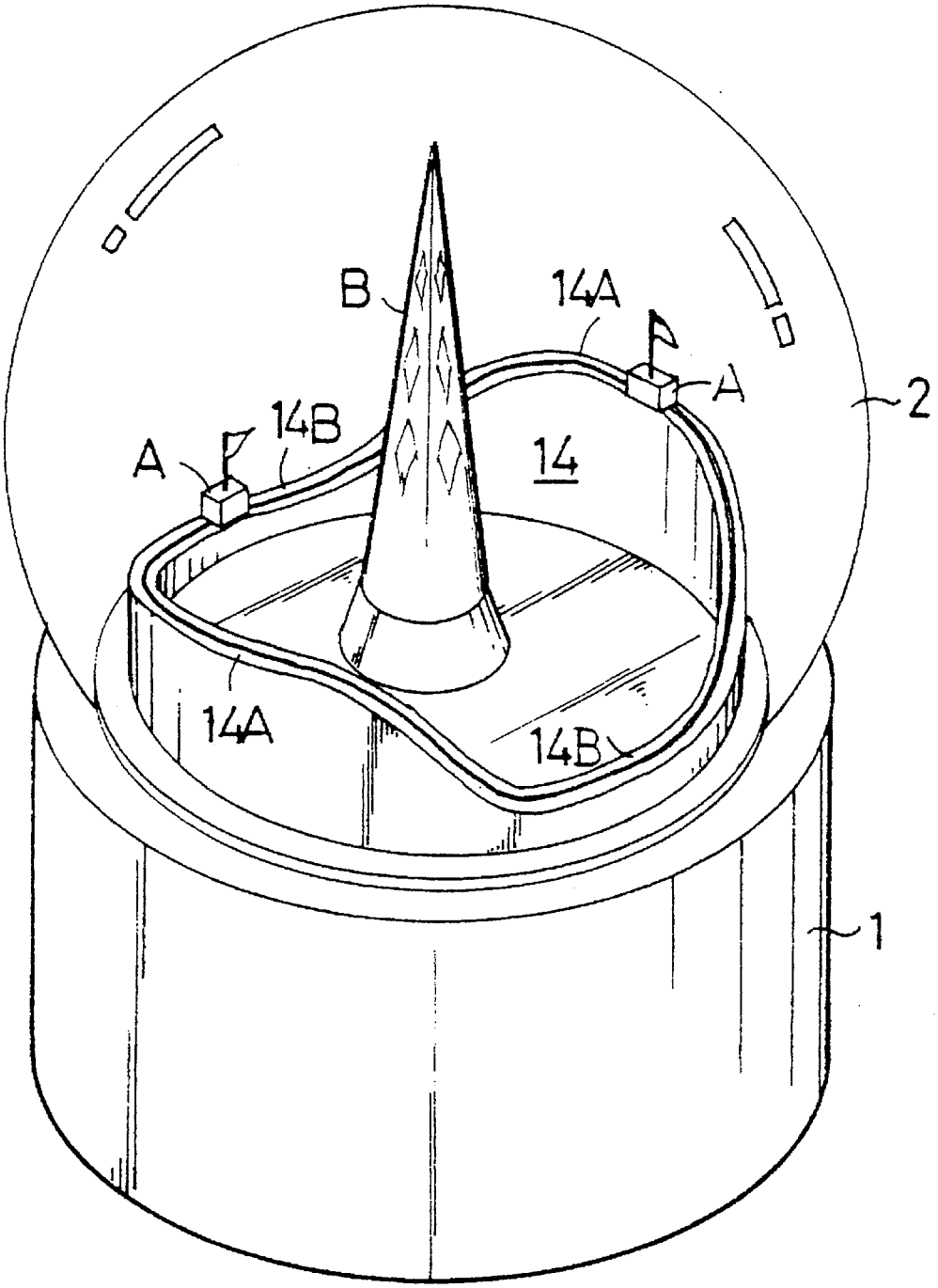
FIG. 1 is a perspective view of the outside of a crystal ball device in accordance with the present invention.
Figure 2:
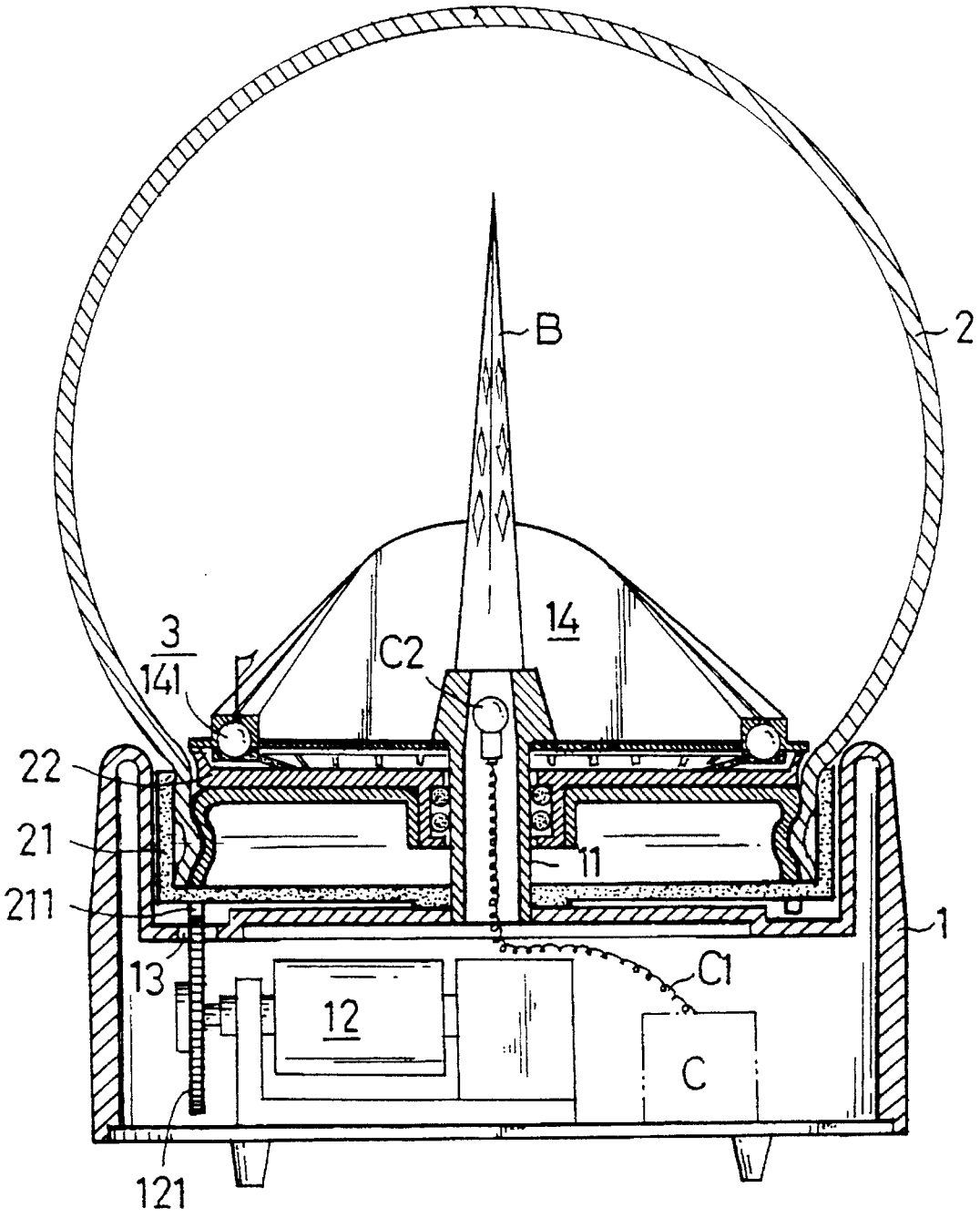
FIG. 2 is a cross-sectional view of the crystal ball of FIG. 1 and also depicts the drive mechanism.

Please refer to FIG. 1 and FIG. 2. This product construction consists of a fixed base or housing (1) and on the top of this fixed base is a ball (2), which is capable of rotating. The above mentioned ball (2) is stopped with a rubber or plastic stopper and is then filled with pure water. At the same time, within the center depression of the fixed base (1) at the bottom of this ball (2) is a rotatable base (21). This rotatable base (21) is supported within the depression of the base (1) on a centrally located vertically central spindle (11) which acts as an axle on which it is free to rotate. Mounted on fixed base (1) is a music box 12 which drives a spindle gear or circular gear (121). Attached to the bottom and around the circumference of base (21) is a circular rack (211). The teeth of this rack (211) meshes with the teeth of the music box spindle gear (121) which acts as a drive for the rack (211) and is located in the bottom of the base (1). The above mentioned rotating base (21) is the driven element and rotates on an axis concentric to the axis of the central spindle (11). Base (21) is fixed to the body of the sphere (2) and rotates as one piece. Because of this, the sphere also has a rotating motion.

Furthermore, central spindle (11), which is the center of rotation of the above mentioned rotating base (21), extends vertically into the space inside the sphere (2). Because of this, a fixed base (14) can be placed at the top of the spindle. Located at the bottom of the glass sphere (2) on the underside of the fixed base (14) around the circumference of separated by a small distance is a plate Shaped unit (22). When the ball (2) rotates, the static nature of the fixed base (14) will not interfere with the rotational nature of the plate shaped unit (22). At the same time, this fixed base (14) can cover the plate shaped unit (22) thus preventing observation of components located in the depression of this plate.

On the top surface, around the circumference of the above mentioned fixed base (14) is attached a circular shaped vertical structure or undulate member with high points (14A) and low depressions (14B). Around the periphery of the top surface of the fixed base (14) is a track assembly with a tubular circulating track (141). Within this circulating track (141) steel balls (3) of diameter just a little smaller than the diameter of the tubular track (141) are inserted. Balls of light plastic but with the same diameter may be used instead. The entire length of the above mentioned track (141) is filled with these steel balls (3). These balls protrude from part of the track (141) by about ⅓ of the balls diameter. This protrusion section must extend for a length of 5 or more ball (3) diameters. See FIG. 3 and FIG. 4.

Also, on the top of the peripheral track (141) on the above mentioned fixed base (14), there is cut a slot (143). Through slot (143), extension rods (31) can be extended and attached to the balls (3) in the track. The extension rods (31) are extending up from the top of the fixed base (14). 0n the top of these extension rods are attached any manner of decorative object (A) which appears to maintain contact with the top of the fixed base (14). Of the above mentioned large number of steel balls (3) filling the irregular track, one or more of these steel balls can be selected to be connected to extension rods (31)

Figure 6:
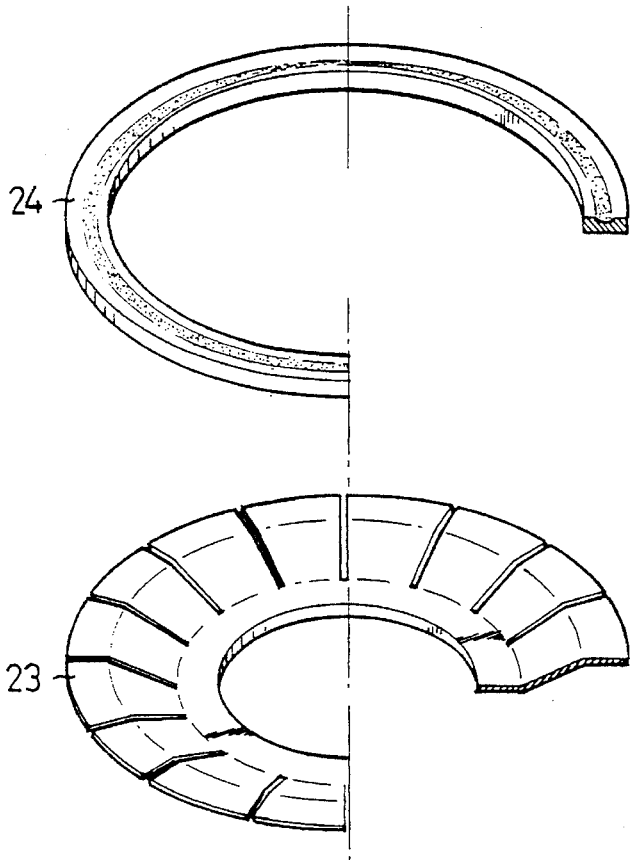
FIG. 6 is a perspective view, partly in cross-section, of the flexible base portion of the ball drive mechanism.
Figure 3:
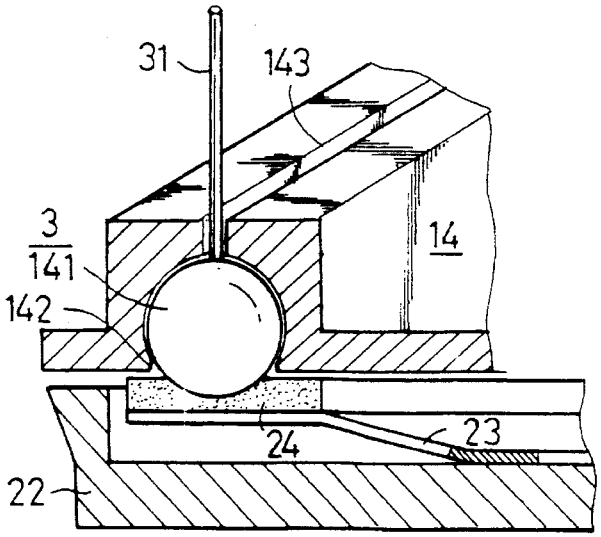
FIG. 3 is a perspective view, partly in cross-section, of the lower part of the fixed base depicting the track and balls, and the flexible ball drive mechanism, including the pan shaped element.
Figure 4:
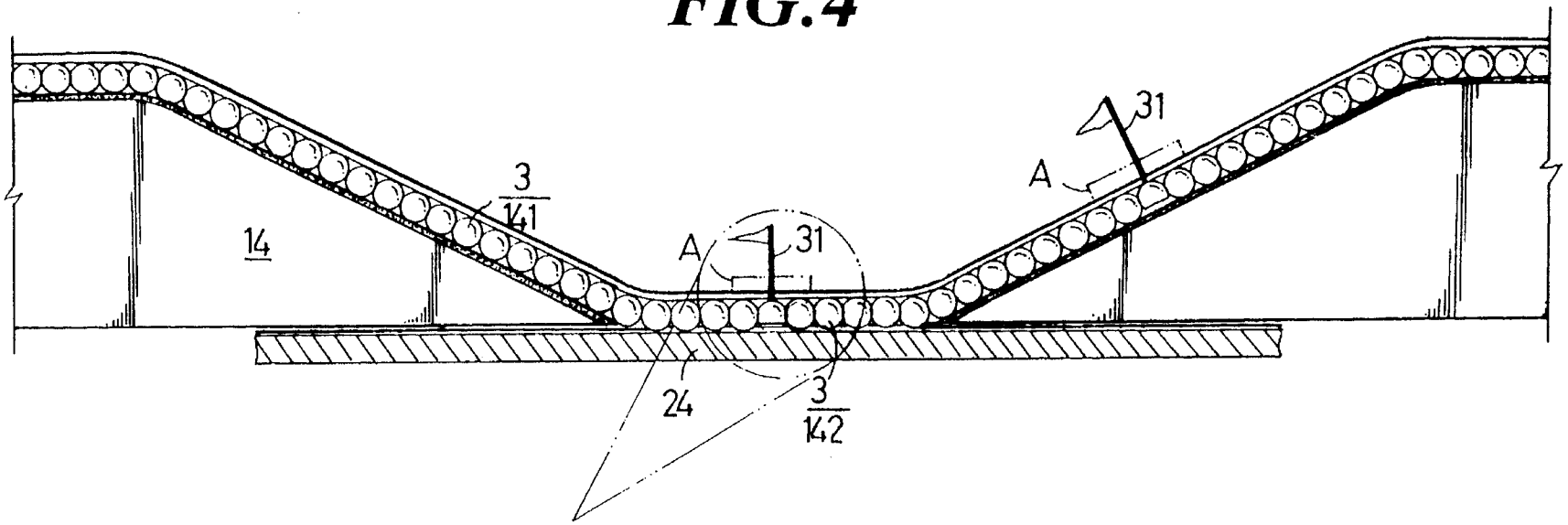
FIG. 4 is an enlarged, schematic cross-sectional view showing the relationship of the balls inside the track and the flexible ball drive mechanism.

Next, Within the depression on the upper side of the above mentioned rotating plate shaped unit (22) can be fastened a flexible base (23). To the top of the elevated edge of this flexible base (23) is attached a pad (24) constructed of plastic or foaming agent, which has a flexible quality as indicated in FIG. 3 and FIG. 6. When the above mentioned flexible base (23) is firmly attached to the plate shaped unit (22). The top part of the above mentioned flexible body (24) contacts the protruding the slot at the low point (14B) of the track on the fixed base. Because of this, the above mentioned dish shaped unit (22) is rotated by the driving element, the spindle of music box (12). When unit (22) it is rotated, the steel balls (3) protruding from the bottom slot of the low point (14B) in the fixed base (14B) are driven by force of friction from the flexible body (24). This makes for a rolling motion of the balls in a fixed direction as indicated in FIG. 4. This pushes the steel balls (3) within the circulating track (141) and causes all the steel balls (3) within the circulating track to move. Because of this, those steel balls with attached extension bars (31) with decorative objects (A) on top can be seen to move along the top of the fixed base (14) resulting in a scene of motion.

Figure 5:
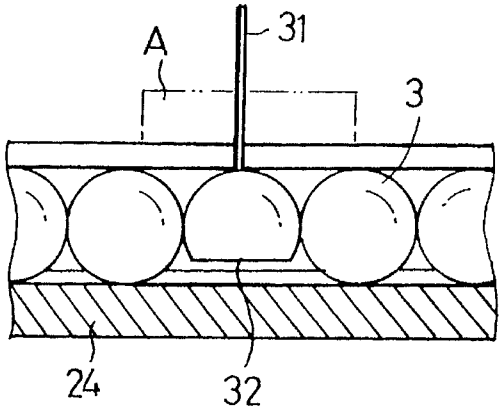
FIG. 5 is an enlarged cross-sectional view of a portion of FIG. 4.

Because of the fact that the steel balls (3) which have the-above mentioned extension bars (31) attached can not roll within the track (141), the motion is dependent on the motion derived from the contact of the flexible body (24) at the fixed base low sections (14B). This may result in an increase of force of friction within the walls of the track. To prevent this friction component, the steel balls (3) with the attached extension bars (31) can be cut off (32) on the bottoms where they come in contact with the flexible body (24) as seen in FIG. 5. When these balls are in the moving part of the above mentioned low point (14B) of the track in the fixed base (14), they do not come in contact with the flexible body (24). Thus the cut off portion (32) of the above mentioned steel balls (3) should not be more than ½ the diameter. In this case, these steel balls (3) while in the track (141), will still maintain the usual linear center to center contact between steel balls (3).

Also, within the body of the glass ball (2) is a clear liquid which can expand or contract with a change in temperature. Because of this, the above mentioned plate shaped unit (22) inserted into the bottom of the glass ball should have the ability to expand outward or contract inward with this expansion or contraction. This allows the space between the fixed base (14) and the plate shaped unit (22) to change dimension. Thus the flexibility of the flexible body (24) and the flexible base (23) within the above mentioned variable space above the plate shaped unit (22) will help maintain the correct pressure applied by the flexible body (24) on the protruding steel balls (3) protruding from the low point (14B) of the fixed base (14).

The steel balls (3) inside the track (141) are dependent on force of friction from the flexible body (24). Because of this, ordinarily the contact face of the flexible substance (24) will be roughened in order to increase the force of friction.

And, the circulating motion of the steel balls (3) within the fixed base track (141) comes completely as a result of the friction force from the flexible body (24) on the steel balls (3) protruding from the slot in the low section (14B) of the fixed base (14). Because of this, even if the high point (14A) of the fixed base (14) has a 360 degree loop, suspended or has an irregular path, the steel balls (3) in the track (141) still have an effective motivating force.

Furthermore, there results a resistive force of friction between the steel balls (3) and the walls of the track (141). Because of the effect of the above mentioned steel balls (3) in the track (141) on the effectiveness of the driver, it is necessary to have more than one low point (14B) in the fixed base (14). It is most advisable to have two or more low point (14B) to maximize effectiveness.

Figure 7:
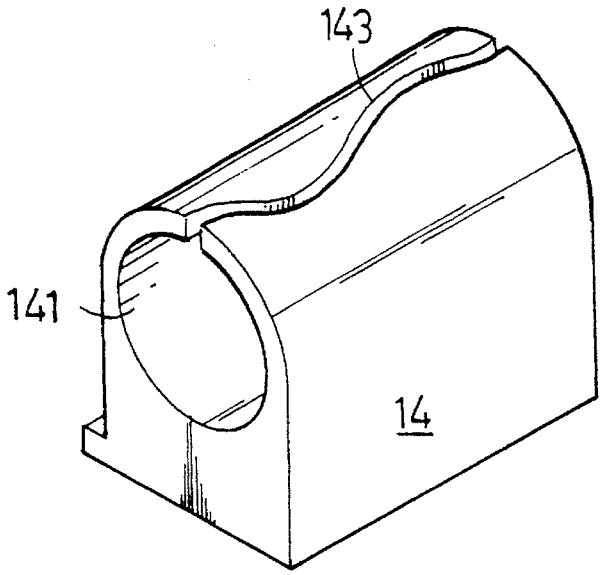
FIG. 7 is a perspective view of a portion of an alternative embodiment of the track showing a wavy slot.
Figure 8:
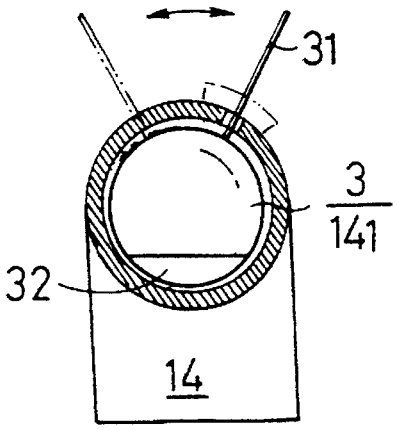
FIG. 8 is a cross-sectional view of the track depicted in FIG. 7.
Figure 9:
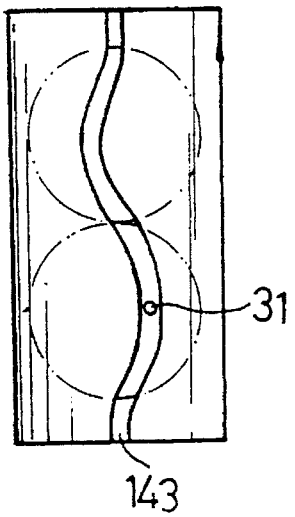
FIG. 9 is a top plan view of FIG. 7.

In the top of the above mentioned track (141) is cut a slot (143) corresponding to the direction of the track (141). If the slot(143) is given a back and forth wave pattern or cork screw pattern in the direction of the slot. This will result in a sign wave motion above the track (141) on the peripheral top edge of the fixed base (14) as shown in FIG. 7. The steel balls (3) which have the extension bars (31) attached,-when traveling through the wavy section mentioned above the extension bars (31) will be tilted and a bobbing motion will be apparent as illustrated in FIG. 8 and FIG. 9.

Figure 10:
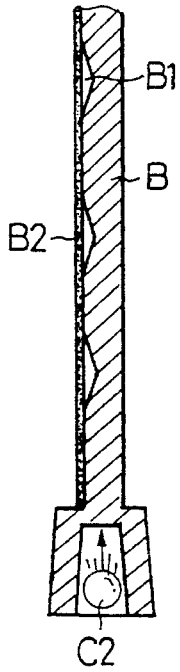
FIG. 10 is a cross-sectional view of the central decorative object B depicted in FIG. 1.

Next, the example implementation shown in FIG. 2 for this product shows the glass sphere (2) is driven by the gear or rock (211) which meshes with the teeth in the peripheral gear (121) in the lower face of the rotating base (14). Thus the above, mentioned glass sphere.(2) is rotated concentric with the central vertical spindle (11). Because of this spindle (11) extends into the-glass sphere (2), a decorative object (B) can be placed on the top of the spindle. This decorative object (B) is manufactured from a translucent substance and different designs can be cut into a carved design such as shown in FIG. 10*a*at (B1). At the same time, decorative object (B) with the above mentioned carved design (B1) on its outer face, can have a glued on outside cover (B2) as seen in FIG. 10. This outside cover (B2) can be made of a water resistant translucent plastic or resin and over the above mentioned carved design (B1). From an electric power source (C) in the base (1) a wire (C1) is threaded into the hollow center of spindle (11) and a light emitting object (C2) can be placed in the base of decorative object (B). The rays from the light source uses the decorative object (B) as a defuser. The spaces in the carved out design (B1) of decorative object (B) and the different indexes of refraction at the interface with the water make for different diffraction patterns. Because of this, the rays from the above mentioned light source can come out from the faces of the carved design.

Figure 11:
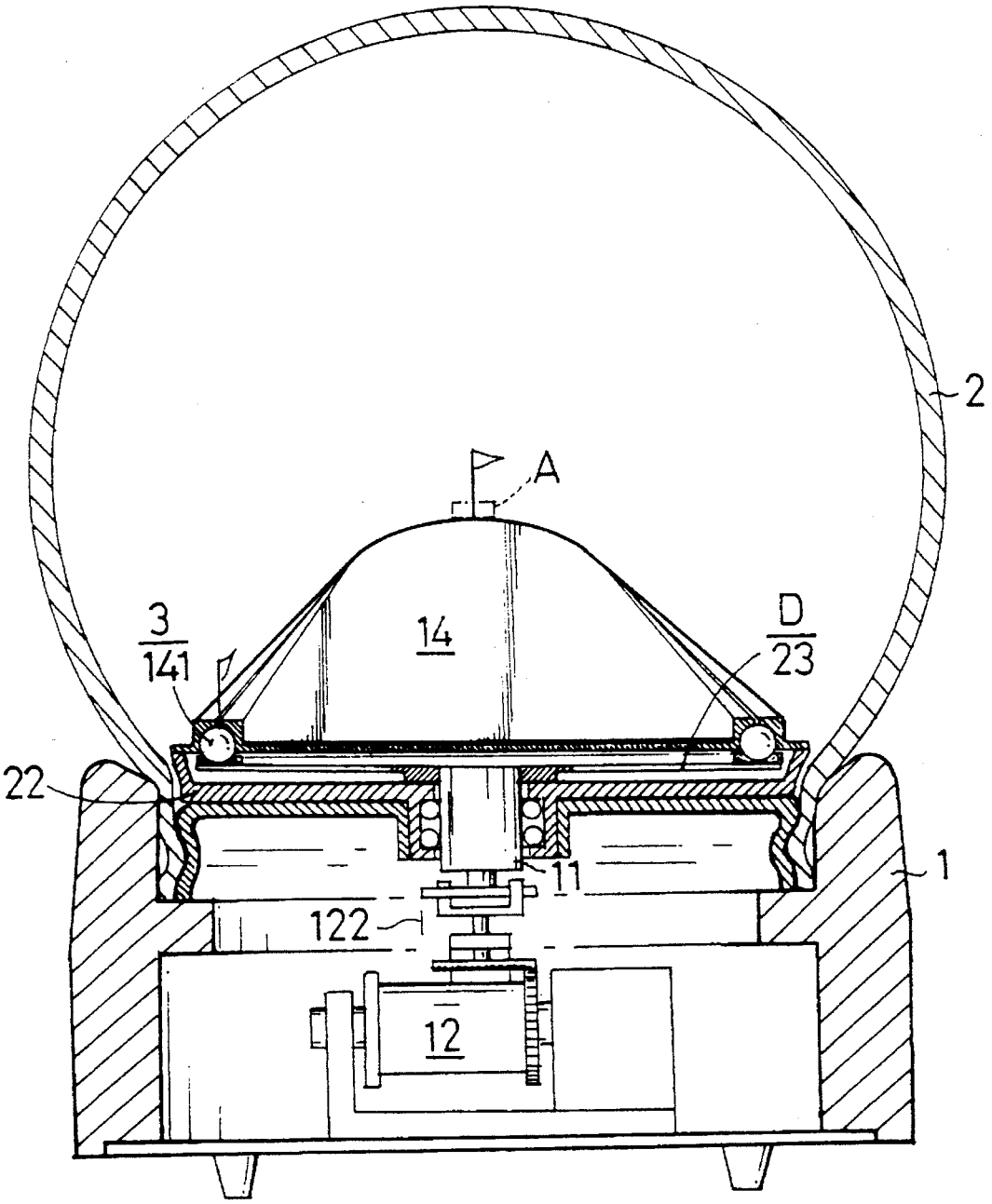
FIG. 11 is a cross-sectional view of an alternative embodiment of the crystal ball and the drive mechanism therefor in which the glass sphere is fixed and there is a driven rotatable central drive spindle.

The glass sphere (2) mentioned in the above implementation is dependent on the ring of teeth (211) on the bottom of the rotating base (21) and the gear (121) which is located in the hollow portion of the base (1). These two parts work together for the purpose of giving rotational motion to the glass sphere (2). The glass sphere (2) which is adjacent to the previously mentioned static fixed base (14) is responsible for driving the steel balls (3) within this base. Only this method can result in the above described driving of the steel balls (3). The method for the rotation of the glass sphere (2) is not the only thing that needs to be decided. Because of this, there may be different implementations of this plan, such as the above mentioned glass sphere (2) which is adjacent to the fixed base (14) which acts as a static base, as shown in FIG. 11. It can also supply the motion to steel balls (3). As for the explanation of the alternate implementations of this invention. The internal parts are the same as those mentioned above, and the set of figures are also the same.

FIG. 11 shows a glass sphere set into a fixed base structure. The fixed plate (14) in this glass sphere (2) is supported solidly by a plate shaped unit (22). This allows the fixed base (14) and plate shaped unit (22) to enclose a layer of space (D). At the same time, within this space (D) is installed a rotatable flexible base (23).

Furthermore, the above mentioned music box spindle (12) is the driver for the rotatable unit (122) above it. Next this drives the centrally located spindle (11). To the top part of this central spindle and in the above stated space (D) is attached a flexible base (23) Because of this, the above stated central spindle (11) can rotate the flexible base (23). This allows the flexible body (24) which is attached to the top of the flexible base (23) to cause the steel balls (3) to move within the fixed base track (141), thus obtaining the above implementation.

Based on the above information, this construction utilizes a round fixed base, and on the periphery of this base is placed a continuous track. Steel balls are placed within this track and on the bottom part of the above mentioned fixed base is installed a flexible base which is driven by a music box cylinder located in the base. From the rotational motion of this flexible base, is derived the driving force necessary to roll the steel balls around the inside of the track. This results in the motion of the decorative objects.

What is claimed is:

1. A decorative structure comprising:

a fixed housing;

a base mounted in said housing;

a central spindle;

a fixed structure attached to one of said spindle and said base;

the other of said spindle and said base being rotatable;

said fixed structure comprising an undulate member having an upper periphery with at least one high portion and at least one low portion with respect to said base, a tubular track having a top portion and an inner diameter and mounted on said periphery such that said track has at least one high portion and at least one low portion, said track low portion having a bottom portion, a plurality of movable objects filling said tubular track, at least one of said movable objects having a protruded extension bar attached thereto and extending upwardly, a top slot in the top portion of said tubular track through which said extension bar extends, and a bottom slot through the bottom portion of the low portion of said tubular track, said bottom slot having a width such that there is access to said movable objects; and drive means for moving said movable objects in said tubular track, said drive means including a rotatable plate unit comprised of a plate having a top and a flexible body mounted on the top of said plate, said flexible body being in contact with said movable objects as a result of said bottom slot.

2. A decorative structure as claimed in claim 1 and further including:

a transparent cover mounted on said base and filled with a liquid which expands and contracts with a change in liquid temperature;

and wherein said fixed structure has a bottom side and said bottom side is spaced from the top of said plate so that as said liquid expands, said flexible body can remain in operable contact with said movable objects.

3. A decorative structure as claimed in claim 1 wherein said member has more than one low portion, called an additional low portion, and a further bottom slot in said additional low portion such that said flexible body can be in contact with said movable objects.

4. A decorative structure as claimed in claim 3 wherein each of the plurality of movable objects has a length and there are at least 10 movable objects in said tubular track, and wherein said bottom slots are each at least as long as the length of five movable objects.

5. A decorative structure as claimed in claim 1 wherein each of the plurality of movable objects has a length and there are at least 10 movable objects in said tubular track, and wherein said bottom slot is at least as long as the length of five movable objects.

6. A decorative structure as claimed in claim 1 wherein said movable objects are balls made of a metal.

7. A decorative structure as claimed in claim 1 wherein said movable objects are balls made of a plastic.

8. A decorative structure as claimed in claim 1 wherein said at least one movable object having an extension bar attached thereto is a ball having a bottom portion thereof removed so that said at least one movable object does not come in contact with said flexible body.

9. A decorative structure as claimed in claim 1 and further including a decorative object attached to said extension bar at a location above said tubular track, and wherein said movable object to which said extension bar is attached is spaced inside said tubular track above said flexible body and out of contact therewith.

10. A decorative structure as claimed in claim 1 wherein at least a portion of said top slot has a sinusoidal pattern in plan view.

11. A decorative structure as claimed in claim 1 wherein said flexible body has a portion with a surface that is in contact with said movable objects, and wherein said surface portion is roughened.

12. A decorative structure as claimed in claim 1 and further including a decorative object mounted on top of said spindle, said decorative object having a carved outer face and a covering mounted on said face.

13. A decorative structure as claimed in claim 12 wherein said decorative object has a bore therein;

and further including a light source placed within said decorative object bore.

14. A decorative structure as claimed in claim 1 wherein said movable objects are balls having a diameter slightly smaller than the inner diameter of said tubular track.

15. A decorative structure as claimed in claim 1 wherein said plate is comprised of an annular base portion and a plurality of flexible leaves mounted on said base portion and extending in a slanted upward direction therefrom; and said flexible body being mounted on said flexible leaves so as to be in flexible contact with said movable objects through said bottom slot.

16. A decorative structure as claimed in claim 15 wherein said movable objects are balls having a diameter slightly smaller than the inner diameter of said tubular track; and wherein said bottom slot has a width such that a portion of said balls protrudes through said bottom slot and said ball portion is in contact with said flexible body.

17. A decorative structure as claimed in claim 16 wherein said flexible body includes a pad having a roughened surface;

and wherein said ball portion protrudes no more than one third of the diameter of said balls.

18. A decorative structure as claimed in claim 1 wherein said base is rotatable, and wherein said central spindle is fixedly mounted on said housing and is stationary and said fixed structure is fixedly attached to said central spindle.

19. A decorative structure as claimed in claim 18 and further including a transparent cover mounted on said base and filled with a liquid, said cover rotating with said base.

20. A decorative structure as claimed in claim 18 and further including a means for rotating said base, said base having an underside, said rotating means comprising:

a music box;

a rotatable drive gear rotated by said music box;

and an annular rack gear mounted on an underside of said base in engagement with said drive gear.

21. A decorative structure as claimed in claim 18 wherein said plate unit is mounted to said base for rotation herewith.

22. A decorative structure as claimed in claim 1 wherein said base is fixedly mounted to said housing and is stationary and said fixed structure is fixedly attached to said base; and wherein said central spindle is rotatable.

23. A decorative structure as claimed in claim 22 and further including a transparent cover mounted on said base and filled with a liquid said cover being stationary.

24. A decorative structure as claimed in claim 22 and further including a means for rotating said spindle, said rotating means comprising:

a music box;

a rotatable drive gear rotated by said music box; and a coupling rotated by said drive gear and connected so as to rotate said spindle.

25. A decorative structure as claimed in claim 22 wherein said rotatable plate unit is fixedly connected to said spindle for rotation therewith.

* * * * *